US005295584A

United States Patent [19]

Krause et al.

[11] Patent Number: 5,295,584

[45] Date of Patent: Mar. 22, 1994

[54] PROCESS FOR SELECTIVE FLOTATION OF PHOSPHORUS MINERALS

[75] Inventors: Jens M. Krause, Hofheim am Taunus; Kurt Bauer, Kelsterbach, both of Fed. Rep. of Germany

[73] Assignee: Hoechst AG, Frankfurt am Main, Fed. Rep. of Germany

[21] Appl. No.: 929,670

[22] Filed: Aug. 13, 1992

[30] Foreign Application Priority Data

Aug. 16, 1991 [DE] Fed. Rep. of Germany ..... 4127151

[51] Int. Cl.[5] ..... B03D 1/01; B03D 1/02

[52] U.S. Cl. ..... 209/166; 252/61; 209/167

[58] Field of Search ..... 209/166, 167, 902; 252/61

[56] References Cited

U.S. PATENT DOCUMENTS

| | | | |
|---|---|---|---|
| 3,779,380 | 12/1973 | Bishop | 209/166 |
| 4,138,350 | 2/1979 | Wang | 209/166 |
| 4,139,481 | 2/1979 | Wang . | |
| 4,158,623 | 6/1979 | Wang et al. . | |
| 4,192,739 | 3/1980 | Wang et al. . | |
| 4,207,178 | 6/1980 | Wang et al. . | |
| 4,309,282 | 1/1982 | Smith | 209/166 |
| 4,358,368 | 11/1982 | Hellsten | 209/167 |
| 4,424,902 | 1/1984 | Silinsky et al. . | |
| 4,968,415 | 11/1990 | Morawietz | 209/166 |

FOREIGN PATENT DOCUMENTS

| | | | |
|---|---|---|---|
| 2037883 | 9/1991 | Canada . | |
| 862990 | 9/1978 | U.S.S.R. | 209/166 |
| 1084076 | 5/1982 | U.S.S.R. | 209/166 |

OTHER PUBLICATIONS

Winnacker and Kuchler, *Chemische Technologie*, 4th Ed., vol. 4 (Metals), 1986, pp. 66–74.

Ivanova, V. A., et al, *Chem. Abs.* 106:104652n (1987).

*Primary Examiner*—Thomas M. Lithgow

*Attorney, Agent, or Firm*—Connolly and Hutz

[57] ABSTRACT

The invention relates to a process for the selective flotation of phosphorus minerals, in which process the flotation collectors used are one or more compounds of the formula 1a and/or 1b

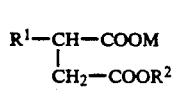

(1a)

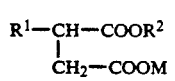

(1b)

wherein $R^1$ is a branched or straight-chain $C_8$–$C_{24}$-, in particular $C_8$–$C_{18}$-alkenyl, $R^2$ is a branched, straight-chain or cyclic alkyl having 5 and/or 6 carbon atoms and M is hydrogen, an alkali metal or alkaline earth metal, ammonium or $NR^3R^4R^5$ where $R^3$, $R^4$ and $R^5$ independently of one another are hydrogen, $C_1$–$C_{20}$-alkyl or $C_1$–$C_{20}$-hydroxyalkyl, optionally as a mixture or combination with co-collectors.

12 Claims, No Drawings

PROCESS FOR SELECTIVE FLOTATION OF PHOSPHORUS MINERALS

The invention relates to the separation of phosphorus minerals such as apatite, phosphorite, francolite and the like from crude ores or preconcentrates by means of flotation with the aid of monoalkyl alkenylsuccinates or of mixtures or combinations of anionic oxyhydro collectors with monoalkyl alkenylsuccinates as flotation collectors.

According to Winnacker and Küchler: Chemische Technologie (Chemical Technology), volume 4 (Metals), 4th edition, Carl Hanser Verlag, Munich, Vienna, 1986, page 66, collectors are organic chemical compounds which carry, in addition to one or more nonpolar hydrocarbon radicals, one or more chemically active polar groups which are capable of adsorbing at active centers of the mineral and thus rendering it hydrophobic.

As is known, flotation (froth flotation treatment) is a widely used sorting process for mineral raw materials, in which one or more valuable minerals are separated from the gangue. The mineral raw material is prepared for flotation by dry, but preferably wet, grinding of the precrushed ore to a suitable particle size, which depends, on the one hand, on the degree of intergrowth, that is to say the size of the individual grains in a mineral composite, and, on the other hand, also on the maximum particle size which can still be floated and which can be very different depending on the mineral. The type of flotation machine used also has an influence on the maximum particle size which can still be floated. Although it is not the rule, it is, however, frequently the case that well crystallized magmatic phosphate ores permit coarser grinding (for example <0.25 Mm) than those of marine sedimentary origin (for example <0.15 Mm).

Further steps for preparation of the ores for flotation can consist in preseparation of the gangue, on the one hand, for example, by gravimetric sorting or heavy liquid separation (removal of relatively coarse constituents) or on the other hand by de-sliming (separation of slurries containing very fine particles). A further possible preenrichment method is the removal of magnetic minerals, which, for example, are virtually always present in phosphate ores of magmatic origin, with the aid of magnetic separation. However, the invention is not restricted to flotation processes which have been preceded by a preconcentration of any type.

With regard to the minerals to be recovered in the froth, a differentiation is made between two procedures. In the case of direct flotation, the valuable mineral or minerals are collected in the froth which is produced on the surface of the flotation liquid which gives rise to their surfaces temporarily being rendered hydrophobic with the aid of one or more collectors. The gangue minerals are then present in the flotation tailings. In the case of inverse flotation, the gangue minerals are rendered hydrophobic by collectors, whilst the flotation tailings form the actual value concentrate. The present invention relates to direct flotation of phosphorus minerals, which, however, can also follow a prior inverse flotation step, which, for example, consists in a flotation of silicate minerals by means of cationic collectors.

A large number of anionic and amphoteric chemical compounds, which include, for example, saturated and unsaturated fatty acids (stearic acid, oleic acid, linoleic acid and linolenic acid) and their sodium, potassium or ammonium salts, mono- and di-alkyl phosphates, alkanesulfoncarboxylic acids, alkylarylsulfonates, acylaminocarboxylic acids and alkylaminocarboxylic acids, are known as collectors for phosphorus minerals.

Collectors are also known which are adducts of sulfosuccinic acid (see, for example, U.S. Pat. Nos. 4,207,178; 4,192,739; 4,158,623; 4,139,481 and SU Patent No. 1,113,317). However, many of these classes of chemical compounds have inadequate selectivity, which does not permit the production of saleable concentrates or makes it necessary to use relatively large amounts of controlling reagents, especially depressing agents for the gangue minerals.

In USSR Certificate of Origin No. 1,084,076 collectors for phosphorus minerals, in particular apatite, of the monoalkyl alkyl- and alkenyl-succinate type having the formula

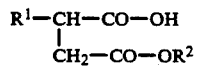

in which $R^1=R^2=C_7-C_{16}$-alkyl or -alkenyl, are described. These collectors are said to be particularly selective. In the flotation experiments with carbonate-silicate apatite ores given ar, examples in this certificate of origin, monoalkyl alkenylsuccinates where $R^1=C_8-C_{10}$-alkenyl and $R^2=C_7-C_{12}$-alkyl or $R^2=C_{10}-C_{16}$-alkyl were used.

In a further publication by W. A. Iwanowa and I. B. Bredermann: "Alkyl(alkenyl)bernsteinsäure-alkylmonoester - effektiver Sammler für die Apatitflotation" [Monoalkyl alkyl (alkenyl) succinate - an effective collector for apatite flotation] (from the book: A. M. Golman and I. L. Dimitrijewa (Editors): Flotationsreagenzien [Flotation reagents], published by "Nauka", Moscow, 1986; see also Chem. Abstr. 106 (14): 104652n) $R^1$ from the above-mentioned formula is likewise restricted to $C_8-C_{12}$-alkenyl or $C_{10}-C_{13}$-alkyl radicals and the primary alcohols used for esterification are restricted to those where $R^2=C_7-C_{12}$ radicals.

The use of monoalkyl $C_8-C_{24}$-alkenylsuccinates, which are esterified with short-chain alcohols ($R^2=C_1-C_4$-alkyl), for the flotation of phosphorus minerals is described in EP-A-0 378 128.

In German Patent Application P 41 06 886.1, which is not a prior publication, the use of these flotation collectors as a mixture or combination with particular co-collectors known per se is proposed, the flotation effect of the collector mixture or combination being synergistically intensified compared with that of the individual collectors.

It has now been found that compounds of the formula

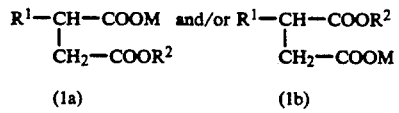

(1a) (1b)

in which $R^1$ is a branched or straight-chain alkenyl radical having 8-24 carbon atoms and $R^2$ is a straight-chain, branched and/or cyclic alkyl radical having 5 or 6 carbon atoms, on their own, in mixtures with one another and also as a mixture or combination with other known co-collectors, have an even better flotation selectivity than the collectors and collector mixtures and collector combinations described in earlier patents and that the products according to the invention, as a mixture or combination with other known co-collectors and/or co-adsorbents, show synergistic flotation effects.

The subject of the present invention is, therefore, a process for the selective flotation of phosphorus minerals, in which process the collectors used for flotation are one or more compounds of the formula (1a) and/or (1b)

where $R^1$=branched and/or straight-chain $C_8$–$C_{24}$-, preferably $C_8$–$C_{18}$-, and in particular $C_8$–$C_{14}$-alkenyl and $R^2$=branched and/or straight-chain and/or cyclic alkyl having 5 or 6 carbon atoms and M=hydrogen, an alkali metal or alkaline earth metal, ammonium or $NR^3R^4R^5$ where $R^3$, $R^4$and $R^5$ independently of one another are hydrogen, $C_1$–$C_{20}$-alkyl or $C_1$–$C_{20}$-hydroxyalkyl, for example triethanolammonium, on their own or as a mixture or combination with known co-collectors, such as, for example, distilled or crude, preferably unsaturated fatty acid fractions, alkylhydroxamic acids N-acylaminocarboxylic acids (for example sarcosinates, caproates), N-alkylaminocarboxylic acids, N-alkyliminodicarboxylic acids, phosphonic acids (for example alkyliminobismethylene- and 1-hydroxyalkane-1,1-diphosphonic acids), alkyl sulfosuccinates and succinamates, oxidized petrolatum, petroleum sulfonates, sulfonamidocarboxylic acids, and many others, optionally with the additional use of nonionic co-adsorbents.

Suitable co-collectors and co-adsorbents are described in German Patent Application P 41 06 866.1

In particular, compounds of the formula 1a and 1b where $R^1$=8–14 carbon atoms and also mixtures and combinations on this basis, according to the invention, have beneficial properties in respect of the flotation effectiveness, activity/selectivity and development, stability and loading capacity of the froth because the olefin content can be kept low during their preparation without high expenditure on process technology.

The mixture or combination with co-collectors which is to be used according to the invention preferably consists of 5 to 95% by weight of one or more compounds according to formula (1a) or (1b) and, correspondingly, 95% to 5% by weight of one or more of the co-collectors described above.

The preparation of the monoalkyl alkenylsuccinates of the formula (1a) or (1b) is carried out in a known manner by reaction of alkenylsuccinic anhydrides with $C_5$- and/or $C_6$-alcohols.

The preparation of the alkenylsuccinic anhydrides as a reaction precursor is carried out by reacting olefins with maleic anhydride in a molar ratio of 1:1; however, on the grounds of better color quality and also for minimizing by-products, it can be appropriate to use an excess of olefin, for example a molar ratio of up to 4:1, preferably between 1:1 and 2:1. After the reaction, the excess olefin is then removed by known methods, for example by distilling off under reduced pressure. If higher olefins are used, which on an industrial scale cannot be removed, or can be removed only with difficulty, by distilling off, even under vacuum, the reaction is appropriately carried out only with a slight olefin excess and the excess olefin is left in the reaction mixture; alternatively, an olefin:maleic anhydride molar ratio of 1:1 is chosen.

Suitable olefins are all compounds with terminal or internal double bonds having 8–24 carbon atoms, and also mixtures thereof; α-olefins are preferred.

The addition reaction takes place at temperatures of between 150° and 270° C., preferably 170° to 250° C., depending on the olefin employed. The reaction is carried out in a reaction vessel suitable for reactions under pressure, appropriately in the presence of an inert gas, it being possible for a pressure of between 2 and 10 bar to be established, depending on the olefin employed and the olefin excess used. 5–20 hours are normally required for the reaction.

The preparation of the alkenylsuccinic acid half-esters of the formula (1a) or (1b) is then carried out in a known manner by reaction of alkenylsuccinic anhydrides with $C_5$- and/or $C_6$-alcohols. For this reaction either a molar ratio of 1:1 is used or, alternatively, the relevant alcohol or the mixture of alcohols is used in excess and after the reaction is complete the excess alcohol component is removed by known methods, for example by distilling off, if appropriate under reduced pressure. Conventional catalysts, such as alkali metal alcoholates or other esterification catalysts, can be used in order to accelerate the reaction. The reaction temperatures are between 60° and 180° C., preferably between 60° and 140° C. The procedure used for normal pressure operation is that the alcohol is metered slowly at elevated temperature into alkenylsuccinic anhydride, which has been initially introduced, and the reaction mixture is then heated stepwise to a temperature of above 120° C. and is stirred for a further 5 to 10 hours at this temperature in order to complete the reaction. Alternatively, after metering the alcohol into the alkenylsuccinic anhydride, the reaction can also be carried out under pressure at elevated temperatures, in which case shorter reaction times are generally achievable.

The co-collectors are known and commercially available products.

It is possible to add the monoalkyl alkenylsuccinates or the collector combination of monoalkyl alkenylsuccinate(s) and co-collector(s) to the flotation together or separately, undiluted or in the form of aqueous solutions.

The collectors, collector mixtures or collector combinations according to the invention are suitable for the flotation of all phosphorus minerals, such as apatite, phosphorite or francolite, from crude ores or preconcentrates containing carbonate, silicate and/or quartz-type gangue, and also from ores of magmatic and also sedimentary or metamorphic origin.

The collectors or the synergistic collector mixtures or combinations are added to the flotation liquid in amounts of preferably 20 to 2000, in particular 50 to 200 g/tonne of crude ore or preconcentrate to be floated. The addition of the collectors or of the collector mixture or combination can be carried out stepwise in several portions or in a single step.

The mixtures or combinations according to the invention, consisting of monoalkyl alkenylsuccinate(s) and co-collector(s), have a synergistic effect compared with the individual components. In this context, a synergistic effect is understood to mean that, for a given amount of collector used (in g of collector per tonne of crude ore), the values recovery R by the collector combination consisting of the collectors A, B, C . . . N is $R_{(A, B, C \ldots N)}$ in % higher than the sum of the participating individual values recoveries $aR_A+bR_B+cR_c+ \ldots nR_N$ determined by calculation, $R_{A,B,C \ldots N}$ being the recovery by the individual collectors A, B, C . . . N and a, b, c . . . n being the proportion of the individual collectors A, B, C . . . N in the total mixture (A, B, C . . . N) and 100% of the total mixture being taken as 1.

$$R_{A,B,C \ldots N} > aR_A + bR_B + cR_c + \ldots nR_N$$

It is also known to modify the flotation characteristics of anionic oxyhydro collectors and collector mixtures in the positive sense by means of co-adsorbents. This modification usually relates not so much to the selectivity of the primary collector but rather to its activity, that is to say to the amount of primary collector employed and to the control of froth development. Modification with co-adsorbents, preferably those which are insoluble in water and have polar character, can also be used for the collectors or collector mixtures or combinations to be used according to the invention. Suitable compounds are, for example, alcohols containing n- or iso-alkyl chains, alkenyl oxide adducts of alcohols, alkylphenols and fatty acids, fatty acid alkanolamides, sorbitan fatty acid esters, polyalkylene glycols, alkyl glycosides and alkenyl glycosides, saturated and unsaturated hydrocarbons, and the like.

The activity, selectivity, froth development, froth stability and froth loading capacity of monoalkyl alkenylsuccinates and their mixtures or combinations with co-collectors are also affected by an olefin content originating from the preparation process. In practical tests it has been found that the olefin content should be as low as possible and should not exceed 20% or preferably 10%.

If co-adsorbents are used for flotation, the ratio of collector mixture or combination to co-adsorbent can vary within wide limits, for example from 10 to 98% by weight for the collector combination and from 90 to 2% by weight for the co-adsorbents. The amount of active substance in the collector combination is usually greater than that of the co-adsorbents, although this does not preclude inverse relationships.

In most cases the collector mixtures or combinations render the phosphorus minerals hydrophobic so selectively that the other minerals present in the ore remain hydrophilic, that is to say are not collected in the froth on the surface of the flotation liquid. However, depending on the mineral composition of the particular ore, it cannot be precluded that one or more depressing agents for the gangue minerals will have to be used in order to improve the success of separation. Suitable inorganic or organic chemical depressing agents are, for example, sodium waterglass, hydrofluoric acid (HF), sodium fluoride (NaF), sodium silicofluoride ($Na_2SiF_6$), hexameta- or tri-polyphosphates, ligninsulfonates and also hydrophilic, relatively low molecular weight polysaccharides, such as starch (corn, rice or potato starch, digested under alkaline conditions), carboxymethylstarch, carboxymethylcellulose, sulfomethylcellulose, gum arabic, guar gums, substituted guar derivatives (for example carboxymethyl-, hydroxypropyl- and carboxymethyl-hydroxypropyl-guars), tannins, alginates, phenol polymers (for example resol, novolak), phenol-formaldehyde copolymers, polyacrylates, polyacrylamides and the like.

Suitable flotation frothing reagents in the process according to the invention are, if necessary, all of the products known for this purpose, such as, for example, aliphatic alcohols and alcohol mixtures, terpene alcohols (pine oils), alkylpolyalkylene glycol ethers or polyalkylene glycols.

The pH value of the flotation liquid also plays a role in the froth flotation of phosphate ores. It is usually between 7 and 11, the treatment preferably being carried out at pH values of 9 to 11 in the case of apatite ores and preferably at pH values of 7 to 9 in the case of phosphorite ores. The optimum pH value of the flotation liquid, which can be decisive for the success of flotation, differs from ore to ore and must be determined by laboratory and plant experiments. Sodium carbonate ($Na_2CO_3$), caustic soda (NAOH) or caustic potash (KOH) can be used to control the pH value.

EXAMPLES

The following reagents were used:

A. Comparison products according to SU Patent 1084076

A1: n-$C_{12}$-Alkenylsuccinic acid mono-n-$C_{12}$ ester, Na salt

A2: i-$C_9$-Alkenylsuccinic acid mono-n-$C_8$–$C_{10}$ ester, Na salt

B. Comparison products according to EP-A-0 378 128

B1: $C_{16}$–$C_{18}$-Alkenylsuccinic acid mono-i-$C_3H_7$ ester, Na salt

B2: $C_{18}$-Alkenylsuccinic acid mono-$CH_3$ ester, Na salt

C. Co-collectors and co-adsorbents

C1: Distilled tall oil fatty acid containing about 30% oleic acid, about 63% linoleic acid, about 2% resin acids and about 2% non-saponifiable matter.

C2: Oleic acid (®Priolene 6900, manufacturer Unichema)

C3: Nonylphenol ethoxylate (®Arkopal N-040, manufacturer Hoechst)

D. Products according to the present invention of the formula $$R^1-\underset{\underset{CH_2-COOR^2}{|}}{CH}-COONa \quad \text{or} \quad R^1-\underset{\underset{CH_2-COONa}{|}}{CH}-COOR^2$$

containing the radicals $R^1$ and $R^2$ in accordance with the following table:

| Designation | $R^1$ alkenyl- | $R^2$ alkyl- |
|---|---|---|
| D1 | $C_{10-12}$ | 3-methylbutyl- |
| D2 | $C_{10-12}$ | n-hexyl- |
| D3 | $C_{12-14}$ | 3-methylbutyl- |
| D4 | $C_{12-14}$ | n-pentyl- |
| D5 | $C_{12-14}$ | n-pentyl-/3-methylbutyl-mixture (65:35) |
| D6 | $C_{12-14}$ | cyclo-hexyl- |
| D7 | $C_{12-14}$ | 4-methylpentl-(2)- |
| D8 | $C_{14-16}$ | 3-methylbutyl |

The natural ores used for the experiments can be characterized as follows:

Ore type A: $P_2O_5$ content about 15%, corresponding to about 36% by mass of apatite; gangue minerals: titanite, titanomagnetite, feldspar, feldspathoids (essentially nepheline), pyroxenes (essentially aegirine) and mica; ground to 80% by mass smaller than 110 μm.

Ore type B: $P_2O_5$ content about 5.7%, corresponding to about 13.5% by mass of apatite; gangue minerals: carbonate minerals (essentially calcite, a little dolomite), pyroxenes (for example augite), and mica (essentially phlogopite), titanomagnetite; magnetite, which was separated off by magnetic separation prior to the flotation; grinding to 80% by mass <270 μm.

In all of the following examples relating to phosphate flotation, in each case about 400 g of natural phosphate ore were floated using a laboratory flotation cell type D-12 from Denver Equipment USA, in a flotation cell of 1.0 l volume (Rougher and Cleaner).

1. Flotation Examples on ore type A

Ore type A was ground wet to 80% by weight smaller than 110 μm. Water having a total salinity of 690 mg/l, the dissolved salt content of which was qualitatively and quantitatively of the same composition as results in the water of an industrial flotation plant, was added to the grinding the flotation. Each flotation experiment consisted of the following steps:

Conditioning of the flotation liquid with 100 g/t of sodium waterglass as dispersing agent for a period of 3 minutes; conditioning of the flotation liquid with the collector, which was added in various amounts (see results), for a period of 3 minutes; Rougher flotation for a period of 2 minutes; three after-treatments (Cleaner flotation) of the froth product obtained in the Rougher flotation (Rougher concentrate); flotation time 2 minutes in each case.

In the tables C=concentrate; F=feed; M1, M2 and M3=middlings and T=tailings.

1.1 Experiments with individual collectors

In Example 1.1 collectors A1 and A2 according to SU Patent 1084076 and collectors B1 and B2 according to EP-A-0 378 128 (Table 1) were compared with the collectors D1, D2, D3, D4, D5, D6, D7 and D8 according to the invention in series flotation tests. One flotation test was carried out with a 35:65 mixture of collectors D3+D4 and compared with collector D5, which was synthesized on the basis of the same alcohol mixture (Table 2). Each collector was tested in three different dosages.

Since the $P_2O_5$ contents of the concentrates (column C) obtained from the flotation tests show a narrow range of fluctuation - with the exception of collectors A2 and D1 (at the highest dosage) they are all within the range of 39.0 . . . 40.9% (average value 39.75) - the $P_2O_5$ recovery can already be used to provide a meaningful comparison of the results.

It is found that the collectors D2, D3, D4, D5, and D7 according to the invention give better $P_2O_5$ recoveries than the comparison collectors A1, A2, B1 and B2, for an equal selectivity, or that the same recovery values are achieved even with a lower collector dosage.

Comparison of the results for the collectors based on alcohols containing 5 carbon atoms ($R^2$) for the same alkenyl radical ($R^1=C_{12-14}$)

D3 (based on 3-methylbutanol)

D4 (based on n-pentanol)

D5 (based on a mixture of 3-methylbutanol and n-pentanol in the ratio of 35:65)

with the result for a collector mixture D3+D4 in a ratio of 35:65 in principle shows an advantage for the collectors based on n-pentanol and 3-methylbutanol mixtures (D5 and mixture of D3+D4) compared with the collectors based on the pure alcohol components (D3 and D4). Collector D5, which was already synthesized from a n-pentanol/3-methylbutanol mixture (65:35), shows a lesser advantage compared with the collector mixture D3+D4.

Collectors D1, D6 and D8 show better flotation results than the comparison collectors A1 and A2, but remain inferior to the results obtained with comparison collectors B1 and B2. Especially in the case of collectors D1 and D8 it can be seen that the chain length of the alkenyl group $R^1$ must be matched to the structure and length of the alcohol radical $R^2$ (in formula 1a or 1b) in order to optimize the effectiveness of the collectors.

1.2 Experiments with co-collectors and co-adsorbents

In Example 1.2 collectors D2 (Table 3) and D3 (Tables 4 and 5) according to the invention were tested on their own and in mixtures of various compositions with the co-collectors C1 and C2 in flotation tests.

Furthermore, a mixture of the collector D3 according to the invention with the co-collector C1 (ratio 1: 1) was also tested in combination with various amounts of the co-adsorbent C3 (Table 6).

In these tests also the $P_2O_5$ contents of the final concentrates (column C) lie within a narrow range of 39.2 . . . 40.4% (average value 39.76), so that the $P_2O_5$ recovery can therefore serve for evaluation of the test results. In the case of the mixtures of D2+C1 and the mixtures of D3+C1 and D3+C2, a synergistic effect is displayed, that is to say the $P_2O_5$ recovery by the mixtures of collectors according to the invention and co-collectors is, for the same selectivity, higher than the recovery which is to be expected from the sum of the individual feeds of collectors according to the invention and co-collectors. In the case of the mixtures of D2+C1 and D3+C1 an optimum recovery is achieved with a ratio of 75:25. In the case of the mixture of D3+C2, only the mixing ratio 50:50 was tested.

In the case of the combination of the 1:1 mixture D3+C1 with additional amounts of the co-adsorbent C3 (Table 4) the recovery is even further improved by the use of co-adsorbent. With respect to the total feed amount (D3+C1+C3), the addition of 10 g/tonne of C3 is most effective.

2. Flotation Examples on ore type B

Ore type B has, on the one hand, a comparatively low apatite content (5.7% $P_2O_5$ corresponding to about 13.5% by mass of apatite) and, on the other hand, a very high calcite content of about 80%. In addition, the grinding of the ore was relatively coarse: $D_{80}$=approximately 0.27 mm. The flotation was carried out using desalinated water. 500 g/t of starch, which had been digested with NAOH, were first added to the flotation liquid (conditioning time 7 minutes), as a result of which a pH value of about 10.5 was established in the flotation liquid. As a result of partial depression of the calcite, the starch assists the selectivity of the flotation procedure. The liquid was then conditioned with the relevant collector (time 3 minutes), this collector being added in various amounts (see Table 7). The flotation then proceeded in the customary manner: complete frothing of a preconcentrate (flotation time 2.5 minutes), the final dirt remaining in the flotation cell; three after-treatments of the preconcentrate (flotation time 2 minutes in each case), the final concentrate and three middlings being obtained. The individual results can be seen in Table 5.

In agreement with the flotation results obtained with ore type A, the superiority of the collectors D2 and D3 according to the invention compared with the comparison collectors A2 (SU Patent 1084076) and B1 (EP-A-0 378 128) is shown in this case also. In respect of activity and selectivity, the comparison collector A2 is considerably poorer than D2 and D3. It is true that the comparison collector B1 is equivalent to the collectors D2 and D3 according to the invention in respect of the selectivity, but more than twice the feed amount has to be used to obtain about the same recovery value.

TABLE 1

Ore Type A

| Sammler (Collector) | Dosage | Masseausbringen (mass recovery) % | | | | | $P_2O_5$-Gehalt ($P_2O_5$ assays) % | | | | | | $P_2O_5$-Ausbringen ($P_2O_5$ recovery) % | | | | |
|---|---|---|---|---|---|---|---|---|---|---|---|---|---|---|---|---|---|
| Type | g/t | C | M3 | M2 | M1 | T | F | C | M3 | M2 | M1 | T | C | M3 | M2 | M1 | T |
| A1 | 200 | 2.3 | 2.0 | 4.8 | 17.4 | 73.5 | 15.2 | 39.5 | 38.2 | 33.3 | 22.7 | 10.6 | 6.0 | 5.1 | 10.6 | 26.0 | 52.3 |
| | 300 | 6.8 | 3.9 | 7.6 | 17.3 | 64.4 | 15.1 | 40.0 | 37.3 | 32.7 | 22.1 | 7.2 | 18.1 | 9.6 | 16.4 | 25.3 | 30.6 |
| | 400 | 11.0 | 4.6 | 7.5 | 16.7 | 60.2 | 15.1 | 40.1 | 37.6 | 32.8 | 20.0 | 5.3 | 29.2 | 11.4 | 16.3 | 22.0 | 21.1 |
| A2 | 150 | 25.7 | 3.7 | 5.9 | 12.3 | 52.4 | 15.3 | 39.2 | 38.7 | 26.0 | 14.9 | 0.8 | 66.0 | 9.3 | 10.0 | 12.0 | 2.7 |
| | 200 | 29.5 | 3.3 | 5.6 | 12.7 | 48.9 | 15.3 | 38.7 | 27.4 | 21.4 | 11.4 | 0.7 | 74.6 | 5.9 | 7.9 | 9.4 | 2.2 |
| | 300 | 33.3 | 3.3 | 6.0 | 11.4 | 46.0 | 15.2 | 36.7 | 22.7 | 17.4 | 8.2 | 0.6 | 80.2 | 5.0 | 6.8 | 6.2 | 1.8 |
| B1 | 90 | 16.7 | 5.4 | 7.2 | 15.1 | 55.6 | 15.4 | 40.0 | 39.0 | 33.2 | 17.9 | 2.6 | 43.2 | 13.6 | 15.6 | 17.5 | 10.1 |
| | 110 | 21.5 | 4.8 | 6.5 | 13.1 | 54.1 | 15.4 | 39.8 | 36.1 | 30.5 | 13.3 | 2.4 | 55.6 | 22.8 | 12.9 | 11.3 | 8.4 |
| | 130 | 26.7 | 3.7 | 5.3 | 11.6 | 52.7 | 15.3 | 39.6 | 35.7 | 25.9 | 9.7 | 1.8 | 68.9 | 8.5 | 9.0 | 7.4 | 6.2 |
| B2 | 130 | 23.1 | 4.0 | 4.8 | 11.2 | 56.9 | 15.2 | 40.2 | 38.8 | 30.3 | 10.8 | 3.0 | 61.1 | 10.2 | 9.5 | 8.0 | 11.2 |
| | 150 | 24.2 | 3.2 | 4.1 | 10.7 | 57.8 | 15.1 | 40.0 | 38.4 | 29.8 | 11.6 | 3.0 | 64.0 | 8.2 | 8.1 | 8.2 | 11.5 |
| | 200 | 27.7 | 2.8 | 4.0 | 11.1 | 54.4 | 15.1 | 39.8 | 35.9 | 26.0 | 10.2 | 1.7 | 72.9 | 6.7 | 6.8 | 7.5 | 6.1 |

TABLE 2

Ore Type A

| Sammler (Collector) | Dosage | Masseausbringen (mass recovery) % | | | | | $P_2O_5$-Gehalt ($P_2O_5$ assays) % | | | | | | $P_2O_5$-Ausbringen ($P_2O_5$ recovery) % | | | | |
|---|---|---|---|---|---|---|---|---|---|---|---|---|---|---|---|---|---|
| Type | g/t | C | M3 | M2 | M1 | T | F | C | M3 | M2 | M1 | T | C | M3 | M2 | M1 | T |
| D1 | 90 | 9.4 | 7.0 | 9.4 | 16.5 | 57.7 | 15.1 | 39.6 | 38.7 | 32.5 | 22.5 | 3.2 | 24.8 | 18.0 | 20.3 | 24.7 | 12.2 |
| | 110 | 16.8 | 7.2 | 7.1 | 14.6 | 54.3 | 15.0 | 39.0 | 37.1 | 29.2 | 17.3 | 2.2 | 43.6 | 17.9 | 13.9 | 16.7 | 7.9 |
| | 130 | 24.5 | 3.3 | 6.1 | 13.8 | 52.3 | 15.0 | 38.4 | 32.4 | 25.3 | 15.2 | 1.7 | 62.7 | 7.1 | 10.3 | 14.0 | 5.9 |
| D2 | 90 | 20.5 | 6.6 | 6.5 | 13.3 | 53.1 | 15.0 | 39.7 | 37.8 | 29.8 | 12.8 | 1.5 | 54.0 | 16.5 | 12.9 | 11.3 | 5.3 |
| | 110 | 25.5 | 4.4 | 5.4 | 12.0 | 52.7 | 15.1 | 39.5 | 34.7 | 27.0 | 10.9 | 1.3 | 67.0 | 10.2 | 9.6 | 8.7 | 4.5 |
| | 130 | 29.2 | 3.3 | 4.6 | 11.5 | 51.4 | 15.0 | 39.3 | 31.6 | 21.2 | 8.7 | 1.0 | 76.5 | 6.9 | 6.5 | 6.7 | 3.4 |
| D3 | 90 | 21.6 | 5.7 | 6.3 | 11.3 | 55.1 | 15.2 | 40.0 | 38.7 | 31.1 | 14.3 | 1.4 | 56.8 | 14.5 | 12.9 | 10.7 | 5.1 |
| | 110 | 27.1 | 4.0 | 5.0 | 11.8 | 52.1 | 15.1 | 39.6 | 35.2 | 25.7 | 9.1 | 1.2 | 71.0 | 9.3 | 8.5 | 7.1 | 4.1 |
| | 130 | 29.5 | 3.4 | 4.7 | 11.2 | 51.2 | 15.1 | 39.2 | 33.0 | 22.4 | 7.5 | 1.0 | 76.7 | 7.4 | 6.9 | 5.6 | 3.4 |
| D4 | 90 | 22.9 | 5.1 | 5.7 | 12.0 | 54.3 | 14.9 | 39.4 | 36.8 | 29.5 | 13.2 | 1.4 | 60.4 | 12.6 | 11.3 | 10.6 | 5.1 |
| | 110 | 27.9 | 3.5 | 4.6 | 10.5 | 53.5 | 15.1 | 39.2 | 35.2 | 25.1 | 10.5 | 1.2 | 72.6 | 8.1 | 7.7 | 7.4 | 4.2 |
| | 130 | 29.4 | 3.1 | 4.5 | 10.9 | 52.1 | 15.0 | 39.0 | 33.2 | 23.9 | 8.2 | 1.1 | 76.3 | 6.8 | 7.1 | 6.0 | 3.8 |
| D5 | 70 | 29.3 | 2.6 | 3.9 | 10.5 | 53.7 | 15.2 | 39.8 | 32.7 | 24.4 | 9.9 | 1.3 | 76.7 | 5.7 | 6.2 | 6.8 | 4.6 |
| | 90 | 31.8 | 1.9 | 3.1 | 11.0 | 52.2 | 15.1 | 39.6 | 30.4 | 20.5 | 6.8 | 1.0 | 83.5 | 3.9 | 4.2 | 5.0 | 3.4 |
| | 110 | 33.8 | 1.6 | 3.0 | 10.3 | 51.3 | 15.0 | 39.4 | 23.7 | 14.8 | 4.7 | 0.8 | 88.6 | 2.5 | 3.0 | 3.2 | 2.7 |
| D6 | 130 | 18.8 | 5.6 | 6.9 | 11.6 | 57.1 | 15.0 | 40.1 | 37.7 | 31.1 | 17.3 | 2.2 | 50.0 | 14.0 | 14.2 | 13.4 | 8.4 |
| | 150 | 25.3 | 4.0 | 5.4 | 10.4 | 54.9 | 15.2 | 39.9 | 35.5 | 28.9 | 12.6 | 1.4 | 66.5 | 9.4 | 10.4 | 8.6 | 5.1 |
| | 175 | 29.3 | 2.7 | 4.1 | 10.0 | 53.9 | 15.2 | 39.6 | 33.9 | 27.6 | 9.3 | 1.2 | 76.2 | 6.0 | 7.4 | 6.1 | 4.3 |
| D7 | 90 | 22.7 | 4.8 | 6.0 | 11.1 | 55.4 | 15.1 | 39.9 | 36.3 | 30.0 | 14.8 | 1.5 | 60.2 | 11.4 | 12.0 | 10.9 | 5.5 |
| | 110 | 27.2 | 3.6 | 4.8 | 10.5 | 53.9 | 15.2 | 39.7 | 35.0 | 27.7 | 10.9 | 1.2 | 71.1 | 8.3 | 8.8 | 7.5 | 4.3 |
| | 130 | 29.9 | 3.1 | 4.5 | 10.2 | 52.3 | 15.2 | 39.5 | 33.2 | 23.3 | 7.8 | 0.9 | 78.0 | 6.7 | 6.9 | 5.3 | 3.1 |
| D8 | 110 | 4.2 | 5.9 | 8.5 | 17.2 | 64.2 | 15.2 | 40.9 | 39.5 | 34.0 | 22.2 | 6.9 | 11.3 | 15.5 | 18.9 | 25.1 | 29.2 |
| | 150 | 9.3 | 6.7 | 7.9 | 16.6 | 59.5 | 15.1 | 40.7 | 39.5 | 32.8 | 19.2 | 4.9 | 25.0 | 17.4 | 17.2 | 21.1 | 19.3 |
| | 200 | 16.1 | 5.8 | 7.2 | 15.7 | 55.2 | 15.2 | 40.5 | 39.2 | 32.5 | 16.0 | 2.8 | 43.1 | 14.9 | 15.3 | 16.5 | 10.2 |
| 35:65 | 90 | 29.4 | 2.6 | 4.3 | 10.6 | 53.1 | 15.3 | 39.8 | 34.3 | 24.5 | 9.8 | 1.1 | 76.6 | 5.9 | 6.9 | 6.8 | 3.8 |
| mixture | 110 | 30.8 | 2.3 | 3.9 | 10.8 | 52.2 | 15.2 | 39.6 | 32.0 | 22.0 | 8.3 | 0.9 | 80.4 | 4.8 | 5.8 | 5.9 | 3.1 |
| or D3 + D | 130 | 33.0 | 1.7 | 3.1 | 8.8 | 53.4 | 15.1 | 39.4 | 28.3 | 20.3 | 6.7 | 0.8 | 86.0 | 3.1 | 4.2 | 3.9 | 2.8 |

TABLE 3

Ore Type A

| Sammler (Collector) | Dosage | Masseausbringen (mass recovery) % | | | | | $P_2O_5$-Gehalt ($P_2O_5$ assays) % | | | | | | $P_2O_5$-Ausbringen ($P_2O_5$ recovery) % | | | | |
|---|---|---|---|---|---|---|---|---|---|---|---|---|---|---|---|---|---|
| Type | g/t | C | M3 | M2 | M1 | T | F | C | M3 | M2 | M1 | T | C | M3 | M2 | M1 | T |
| D2 | 90 | 20.5 | 6.6 | 6.5 | 13.3 | 53.1 | 15.0 | 39.7 | 37.8 | 29.8 | 12.8 | 1.5 | 54.0 | 16.5 | 12.9 | 11.3 | 5.3 |
| | 110 | 25.5 | 4.4 | 5.4 | 12.0 | 52.7 | 15.1 | 39.5 | 34.7 | 27.0 | 10.9 | 1.3 | 67.0 | 10.2 | 9.6 | 8.7 | 4.5 |
| | 130 | 29.2 | 3.3 | 4.6 | 11.5 | 51.4 | 15.0 | 39.3 | 31.6 | 21.2 | 8.7 | 1.0 | 76.5 | 6.9 | 6.5 | 6.7 | 3.4 |
| D2 + C1 | 70 | 25.1 | 3.5 | 5.0 | 11.7 | 54.7 | 15.3 | 40.1 | 35.3 | 27.8 | 15.0 | 1.5 | 65.8 | 8.1 | 9.2 | 11.5 | 5.4 |
| mixture | 90 | 29.8 | 2.3 | 3.8 | 11.2 | 52.9 | 15.2 | 39.9 | 32.8 | 23.5 | 9.7 | 1.1 | 78.3 | 4.9 | 5.9 | 7.1 | 3.8 |
| 75:25 | 110 | 32.3 | 1.6 | 3.5 | 10.8 | 51.8 | 15.3 | 39.7 | 28.8 | 19.6 | 7.2 | 1.0 | 84.1 | 2.9 | 4.5 | 5.1 | 3.4 |
| 50:50 | 70 | 22.3 | 3.7 | 5.3 | 13.7 | 55.0 | 15.3 | 40.1 | 37.4 | 31.2 | 16.0 | 2.0 | 58.6 | 5.9 | 10.9 | 14.4 | 7.2 |
| | 90 | 27.7 | 2.4 | 4.3 | 11.0 | 54.6 | 15.2 | 39.8 | 33.2 | 26.3 | 12.9 | 1.5 | 72.6 | 5.2 | 7.4 | 9.4 | 5.4 |
| | 110 | 30.5 | 1.7 | 3.7 | 10.9 | 53.2 | 15.2 | 39.5 | 29.7 | 22.3 | 11.0 | 1.2 | 79.2 | 3.3 | 5.4 | 7.9 | 4.2 |
| 25:75 | 90 | 19.1 | 4.1 | 6.9 | 14.7 | 55.2 | 15.2 | 40.4 | 38.0 | 32.4 | 18.4 | 1.7 | 50.9 | 10.3 | 14.7 | 17.9 | 6.2 |
| | 110 | 24.8 | 3.1 | 5.1 | 12.3 | 54.7 | 15.2 | 40.1 | 36.3 | 28.2 | 15.3 | 1.5 | 65.3 | 7.4 | 9.5 | 12.4 | 5.4 |
| | 130 | 27.2 | 2.8 | 4.9 | 12.1 | 53.0 | 15.2 | 39.9 | 34.1 | 26.4 | 12.5 | 1.2 | 71.0 | 6.4 | 8.5 | 9.9 | 4.2 |

TABLE 3-continued

| Sammler (Collector) | | Ore Type A | | | | | | | | | | | | | | | |
|---|---|---|---|---|---|---|---|---|---|---|---|---|---|---|---|---|---|
| | | Masseausbringen (mass recovery) % | | | | | | $P_2O_5$-Gehalt ($P_2O_5$ assays) % | | | | | $P_2O_5$-Ausbringen ($P_2O_5$ recovery) % | | | | |
| Type | Dosage g/t | C | M3 | M2 | M1 | T | F | C | M3 | M2 | M1 | T | C | M3 | M2 | M1 | T |
| C1 | 110 | 6.3 | 7.9 | 11.7 | 17.7 | 56.4 | 15.0 | 39.6 | 38.1 | 35.1 | 22.9 | 2.4 | 16.8 | 19.9 | 27.4 | 26.9 | 9.0 |
| | 150 | 12.2 | 7.5 | 9.8 | 16.5 | 54.0 | 15.0 | 39.5 | 37.7 | 32.7 | 19.1 | 1.9 | 32.0 | 19.0 | 21.3 | 20.9 | 6.8 |
| | 200 | 18.2 | 6.4 | 8.5 | 14.6 | 52.3 | 15.1 | 39.4 | 37.6 | 30.6 | 13.9 | 1.6 | 47.7 | 15.9 | 17.3 | 13.5 | 5.6 |

TABLE 4

| Sammler (Collector) | | Ore Type A | | | | | | | | | | | | | | | |
|---|---|---|---|---|---|---|---|---|---|---|---|---|---|---|---|---|---|
| | | Masseausbringen (mass recovery) % | | | | | | $P_2O_5$-Gehalt ($P_2O_5$ assays) % | | | | | $P_2O_5$-Ausbringen ($P_2O_5$ recovery) % | | | | |
| Type | Dosierung g/t | C | M3 | M2 | M1 | T | F | C | M3 | M2 | M1 | T | C | M3 | M2 | M1 | T |
| C1 | 110 | 6.3 | 7.9 | 11.7 | 17.7 | 56.4 | 15.0 | 39.6 | 38.1 | 35.1 | 22.9 | 2.4 | 16.8 | 19.9 | 27.4 | 26.9 | 9.0 |
| | 150 | 1.2 | 7.5 | 9.8 | 16.5 | 54.0 | 15.0 | 39.5 | 37.7 | 32.7 | 19.1 | 1.9 | 32.0 | 19.0 | 21.3 | 20.9 | 6.8 |
| | 200 | 18.2 | 6.4 | 8.5 | 14.6 | 52.3 | 15.1 | 39.4 | 37.6 | 30.6 | 13.9 | 1.6 | 47.7 | 15.9 | 17.3 | 13.5 | 5.6 |
| D3 + C1 | 90 | 21.3 | 3.9 | 6.0 | 13.1 | 55.7 | 15.2 | 40.0 | 36.6 | 30.8 | 17.6 | 2.0 | 56.0 | 9.4 | 12.1 | 15.1 | 7.4 |
| mixture | 110 | 25.3 | 3.0 | 5.4 | 11.9 | 54.4 | 15.2 | 39.8 | 24.9 | 28.6 | 15.1 | 1.4 | 66.1 | 6.9 | 10.1 | 11.9 | 5.0 |
| 25:75 | 130 | 27.6 | 2.7 | 4.5 | 12.2 | 53.0 | 15.2 | 39.6 | 32.9 | 26.1 | 12.8 | 1.2 | 71.9 | 5.9 | 7.8 | 10.2 | 4.2 |
| 50:50 | 70 | 23.8 | 3.3 | 5.0 | 12.2 | 55.7 | 15.3 | 40.2 | 38.3 | 30.4 | 15.8 | 1.8 | 62.6 | 8.2 | 10.0 | 12.6 | 6.6 |
| | 90 | 29.1 | 2.0 | 3.6 | 11.2 | 54.1 | 15.2 | 39.8 | 33.3 | 25.4 | 12.1 | 1.3 | 76.0 | 4.4 | 6.1 | 8.9 | 4.6 |
| | 110 | 30.9 | 1.8 | 3.5 | 10.7 | 53.1 | 15.2 | 39.6 | 28.7 | 20.9 | 10.6 | 1.1 | 80.5 | 3.3 | 4.9 | 7.5 | 3.8 |
| 75:25 | 70 | 26.9 | 2.8 | 4.5 | 11.0 | 54.8 | 15.2 | 40.3 | 36.0 | 27.7 | 11.9 | 1.4 | 71.5 | 6.6 | 8.2 | 8.7 | 5.0 |
| | 90 | 31.5 | 1.8 | 3.3 | 9.6 | 53.8 | 15.2 | 39.7 | 30.7 | 22.0 | 8.9 | 1.1 | 82.2 | 3.5 | 4.8 | 5.6 | 3.9 |
| | 110 | 33.4 | 1.4 | 3.3 | 9.3 | 52.6 | 15.2 | 39.4 | 26.1 | 18.7 | 6.5 | 0.8 | 86.5 | 2.5 | 4.1 | 4.0 | 2.8 |
| D3 | 90 | 21.6 | 5.7 | 6.3 | 11.3 | 55.1 | 15.2 | 40.0 | 38.7 | 31.1 | 14.3 | 1.4 | 56.8 | 14.5 | 12.9 | 10.7 | 5.1 |
| | 110 | 27.1 | 4.0 | 5.0 | 11.8 | 52.1 | 15.1 | 39.6 | 35.2 | 25.7 | 9.1 | 1.2 | 71.0 | 9.3 | 8.5 | 7.1 | 4.1 |
| | 130 | 29.5 | 3.4 | 4.7 | 11.2 | 51.2 | 15.1 | 39.2 | 33.0 | 22.4 | 7.5 | 1.0 | 76.7 | 7.4 | 6.9 | 5.6 | 3.4 |

TABLE 5

| Sammler (Collector) | | Ore Type A | | | | | | | | | | | | | | | |
|---|---|---|---|---|---|---|---|---|---|---|---|---|---|---|---|---|---|
| | | Masseausbringen (mass recovery) % | | | | | | $P_2O_5$-Gehalt ($P_2O_5$ assays) % | | | | | $P_2O_5$-Ausbringen ($P_2O_5$ recovery) % | | | | |
| Type | Dosierung g/t | C | M3 | M2 | M1 | T | F | C | M3 | M2 | M1 | T | C | M3 | M2 | M1 | T |
| D3 | 90 | 21.6 | 5.7 | 6.3 | 11.3 | 55.1 | 15.2 | 40.0 | 38.7 | 31.1 | 14.3 | 1.4 | 56.8 | 14.5 | 12.9 | 10.7 | 5.1 |
| | 110 | 27.1 | 4.0 | 5.0 | 11.8 | 52.1 | 15.1 | 39.6 | 35.2 | 25.7 | 9.1 | 1.2 | 71.0 | 9.3 | 8.5 | 7.1 | 4.1 |
| | 130 | 29.5 | 3.4 | 4.7 | 11.2 | 51.2 | 15.1 | 39.2 | 33.0 | 22.4 | 7.5 | 1.0 | 76.7 | 7.4 | 6.9 | 5.6 | 3.4 |
| 50:50 | 70 | 27.6 | 2.6 | 4.6 | 11.7 | 53.5 | 15.3 | 40.4 | 34.9 | 25.2 | 10.6 | 1.5 | 73.1 | 5.9 | 7.6 | 8.2 | 5.2 |
| mixture | 90 | 31.2 | 1.9 | 3.4 | 11.6 | 51.9 | 15.2 | 40.0 | 30.1 | 20.8 | 7.3 | 1.1 | 82.1 | 3.8 | 4.7 | 5.6 | 3.8 |
| of D3 + C2 | 110 | 32.8 | 1.5 | 3.5 | 10.8 | 51.4 | 15.2 | 39.8 | 26.3 | 16.5 | 6.3 | 1.0 | 85.7 | 2.7 | 3.8 | 4.4 | 3.4 |
| C2 | 200 | 9.0 | 4.1 | 7.6 | 16.7 | 62.6 | 15.0 | 40.1 | 38.4 | 34.0 | 24.4 | 5.1 | 24.1 | 10.4 | 17.1 | 27.1 | 21.3 |
| | 250 | 15.7 | 4.3 | 7.6 | 14.0 | 58.4 | 15.1 | 39.9 | 37.4 | 33.0 | 19.2 | 3.5 | 41.4 | 10.7 | 16.6 | 17.8 | 13.5 |
| | 300 | 19.7 | 3.9 | 6.2 | 13.6 | 56.6 | 15.1 | 39.7 | 36.7 | 30.6 | 17.0 | 2.9 | 51.9 | 9.3 | 12.6 | 15.3 | 10.9 |

TABLE 6

| Sammler (Collector) | | Ore Type A | | | | | | | | | | | | | | | |
|---|---|---|---|---|---|---|---|---|---|---|---|---|---|---|---|---|---|
| | | Masseausbringen (mass recovery) % | | | | | | $P_2O_5$-Gehalt ($P_2O_5$ assays) % | | | | | $P_2O_5$-Ausbringen ($P_2O_5$ recovery) % | | | | |
| Type | Dosierung g/t | C | M3 | M2 | M1 | T | F | C | M3 | M2 | M1 | T | C | M3 | M2 | M1 | T |
| Three | (50) + 10 | 26.1 | 2.5 | 3.9 | 10.9 | 56.6 | 15.1 | 39.8 | 33.6 | 21.2 | 16.6 | 2.2 | 68.8 | 5.5 | 5.5 | 12.0 | 8.2 |
| mixtures | (70) + 10 | 31.4 | 1.4 | 3.0 | 9.8 | 54.4 | 15.1 | 39.6 | 31.3 | 21.0 | 8.7 | 1.4 | 82.2 | 2.9 | 4.2 | 5.7 | 5.0 |
| of | (90) + 10 | 33.8 | 0.9 | 2.6 | 9.6 | 53.1 | 15.2 | 39.4 | 24.8 | 17.9 | 6.8 | 1.0 | 87.6 | 1.5 | 3.1 | 4.3 | 3.5 |
| (D3 + C1 | (50) + 30 | 29.4 | 2.9 | 3.3 | 10.5 | 53.9 | 15.3 | 39.9 | 34.9 | 21.5 | 8.5 | 1.7 | 77.0 | 6.6 | 4.6 | 5.8 | 6.0 |
| in a | (70) + 30 | 32.8 | 1.6 | 3.0 | 9.6 | 53.0 | 15.2 | 39.6 | 30.3 | 17.6 | 5.9 | 1.3 | 85.2 | 3.2 | 3.4 | 3.7 | 4.5 |
| ratio of | (90) + 30 | 34.1 | 1.4 | 2.7 | 9.6 | 52.2 | 15.2 | 39.3 | 28.8 | 16.6 | 4.2 | 1.1 | 88.0 | 2.6 | 2.9 | 2.7 | 3.8 |
| 1:1) + C3 | (50) + 50 | 30.1 | 2.9 | 3.1 | 9.6 | 54.3 | 15.3 | 40.2 | 35.1 | 22.7 | 7.2 | 1.4 | 79.2 | 6.6 | 4.7 | 4.5 | 5.0 |
| | (70) + 50 | 33.1 | 1.8 | 2.9 | 9.5 | 52.7 | 15.2 | 39.8 | 30.1 | 16.3 | 4.8 | 1.1 | 86.5 | 3.5 | 3.2 | 3.0 | 3.8 |
| | (90) + 50 | 34.6 | 1.4 | 3.3 | 9.2 | 51.5 | 15.2 | 39.4 | 23.5 | 12.1 | 3.8 | 0.9 | 89.9 | 2.2 | 2.6 | 2.3 | 3.0 |

TABLE 7

| Sammler (Collector) | | Ore Type B | | | | | | | | | | | | | | | |
|---|---|---|---|---|---|---|---|---|---|---|---|---|---|---|---|---|---|
| | Dosierung | Masseausbringen (mass recovery) % | | | | | $P_2O_5$-Gehalt ($P_2O_5$ assays) % | | | | | | $P_2O_5$-Ausbringen ($P_2O_5$ recovery) % | | | | |
| Type | g/t | C | M3 | M2 | M1 | T | F | C | M3 | M2 | M1 | T | C | M3 | M2 | M1 | T |
| A2 | 60 | 9.4 | 4.0 | 5.7 | 9.9 | 71.0 | 5.9 | 14.9 | 13.6 | 11.9 | 10.9 | 3.1 | 23.9 | 9.1 | 11.5 | 18.2 | 37.3 |
| | 75 | 11.1 | 4.1 | 6.4 | 9.4 | 69.0 | 5.8 | 14.3 | 12.9 | 12.9 | 11.2 | 2.6 | 27.4 | 9.2 | 14.2 | 18.2 | 31.0 |
| | 100 | 18.7 | 4.6 | 6.8 | 10.2 | 59.7 | 5.9 | 13.1 | 1.4 | 11.1 | 10.3 | 1.7 | 41.9 | 9.8 | 13.0 | 18.0 | 17.3 |
| B1 | 130 | 7.4 | 3.3 | 5.1 | 7.6 | 76.6 | 5.8 | 31.5 | 19.0 | 12.9 | 7.0 | 2.2 | 39.9 | 10.7 | 11.4 | 9.1 | 28.9 |
| | 150 | 11.1 | 4.0 | 5.1 | 8.7 | 71.1 | 5.9 | 31.0 | 15.2 | 9.4 | 4.6 | 1.3 | 58.6 | 10.5 | 8.3 | 6.8 | 15.8 |
| | 175 | 13.6 | 3.8 | 5.7 | 9.6 | 67.3 | 5.9 | 30.6 | 12.3 | 5.9 | 3.2 | 0.9 | 70.7 | 8.0 | 5.7 | 5.3 | 10.3 |
| D2 | 60 | 7.5 | 2.9 | 4.3 | 7.7 | 77.6 | 5.8 | 33.6 | 22.3 | 15.2 | 8.4 | 1.7 | 43.5 | 11.1 | 11.3 | 11.3 | 22.8 |
| | 75 | 11.5 | 3.5 | 4.8 | 7.9 | 72.3 | 5.9 | 30.2 | 16.2 | 9.2 | 5.4 | 1.3 | 59.5 | 9.6 | 7.5 | 7.3 | 16.1 |
| | 90 | 17.5 | 3.8 | 5.6 | 10.3 | 62.8 | 5.9 | 25.4 | 9.7 | 5.9 | 3.1 | 0.7 | 75.3 | 6.3 | 5.6 | 5.4 | 7.4 |
| D3 | 50 | 5.6 | 2.9 | 4.2 | 7.2 | 80.1 | 5.9 | 31.4 | 19.4 | 13.3 | 9.3 | 2.9 | 29.7 | 9.6 | 9.6 | 11.5 | 39.6 |
| | 60 | 8.9 | 3.5 | 4.7 | 7.8 | 75.1 | 5.9 | 30.8 | 17.9 | 11.8 | 7.3 | 1.8 | 47.0 | 10.8 | 9.4 | 9.7 | 23.1 |
| | 75 | 13.7 | 3.6 | 5.2 | 8.2 | 69.3 | 5.7 | 27.9 | 12.6 | 7.1 | 4.7 | 1.0 | 66.8 | 7.9 | 6.5 | 6.7 | 12.1 |

we claim:

1. A process for the selective flotation of phosphorus minerals, which comprises subjecting a suspension containing said phosphorus minerals to flotation in the presence of at least one flotation collector, in which process the flotation collectors used are one or more compounds of the formula 1a and/or 1b $$R^1-\underset{\underset{CH_2-COOR^2}{|}}{CH}-COOM \quad (1a)$$

$$R^1-\underset{\underset{CH_2-COOM}{|}}{CH}-COOR^2 \quad (1b)$$

wherein $R^1$ is a branched or straight-chain $C_8$–$C_{24}$-alkenyl, $R^2$ is a branched, straight-chain or cyclic alkyl having, independently, in each occurrence, 5 or 6 carbon atoms and M is hydrogen, an alkali metal or alkaline earth metal, ammonium or $NR^3R^4R^5$ where $R^3$, $R^4$and $R^5$ independently of one another are hydrogen, $C_1$–$C_{20}$-alkyl or $C_1$–$C_{20}$-hydroxyalkyl, optionally as a mixture or combination with co-collectors.

2. The process as claimed in claim 1, wherein the flotation collector used is a mixture or combination which consists of 5 to 95% by weight of one or more compounds of the formula 1a and/or 1b and 95 to 5% by weight of one or more known co-collectors.

3. The process as claimed in claim 1, wherein the phosphorus minerals are floated from ores or preconcentrates which contain carbonate or silicate or quartz minerals or mixtures thereof as gangue components.

4. The process as claimed in claim 1, wherein a froth is produced on the surface of a flotation liquid, and the flotation liquid has a pH value of 7 to 11.

5. The process as claimed in claim 1, wherein the flotation collector or the mixture or combination is used together with nonionic co-adsorbents.

6. The process as claimed in claim 1, wherein the flotation collector or the mixture or combination is used together with a flotation frothing agent.

7. The process as claimed in claim 1, wherein the flotation collector or the mixture or combination is used together with a depressing agent for the gangue minerals.

8. The process as claimed in claim 1, wherein a froth is produced on the surface of a flotation liquid, and the flotation collector of the collector mixture or combination is added to the flotation liquid in an amount of 20 to 2000 g/tonne of ore containing the phosphorus minerals.

9. The process as claimed in claim 1, wherein a froth is produced on the surface of a flotation liquid, and the flotation collector of the collector mixture or combination is added to the flotation liquid in an amount of 50 to 200 g/tonne of ore containing the phosphorus minerals.

10. The process as claimed in claim 5, wherein the flotation collector or the mixture or combination contains up to 20% by weight of olefins of chain length $R^1$.

11. The process as claimed in claim 1, wherein $R^1$ is branched or straight-chain $C_8$–$C_{18}$-alkenyl.

12. The process as claimed in 5, wherein the flotation collector or the mixture or combination contains up to 10% by weight of olefins of the chain length of $R^1$.

* * * * *